United States Patent [19]

Richardson

[11] Patent Number: 5,034,021

[45] Date of Patent: Jul. 23, 1991

[54] APPARATUS FOR THERMAL PYROIVSIS OF CRUSHED COAL

[76] Inventor: Reginald D. Richardson, 57 Widdicombe Hill Blvd., Apt. 1504, Weston, Ontario, Canada, M9A 1Y4

[21] Appl. No.: 378,744

[22] Filed: Jul. 12, 1989

Related U.S. Application Data

[62] Division of Ser. No. 873,925, Jun. 6, 1986, Pat. No. 4,900,429.

[51] Int. Cl.[5] ..... C10J 3/20; C10J 3/58; C10B 1/04

[52] U.S. Cl. ..... 48/77; 48/63; 48/67; 202/86; 202/94; 202/99; 202/215; 201/34; 201/36

[58] Field of Search ..... 48/76, 77, 63, 67, 202, 48/203, 210; 201/33, 34, 36; 202/86, 94, 99, 215

[56] References Cited

U.S. PATENT DOCUMENTS

| | | | |
|---|---|---|---|
| 1,592,467 | 7/1926 | Rosenthal | 48/203 |
| 2,662,816 | 12/1953 | Kalbach | 48/202 |
| 2,743,217 | 4/1956 | Silsby | 201/36 |
| 3,454,382 | 7/1969 | Hamilton | 48/76 |
| 3,663,421 | 5/1972 | Parr | 201/36 |
| 3,801,469 | 4/1974 | Essenhigh | 201/34 |
| 4,069,107 | 1/1978 | Koppelman et al. | 201/34 |
| 4,152,122 | 5/1979 | Feldmann | 202/99 |
| 4,336,125 | 6/1982 | Weil et al. | 201/36 |
| 4,431,509 | 2/1984 | Tarman | 48/210 |
| 4,571,249 | 2/1986 | Bonasso et al. | 48/63 |

*Primary Examiner*—Joye L. Woodard
*Attorney, Agent, or Firm*—Rogers, Bereskin & Parr

[57] ABSTRACT

Apparatus is described for the pyrolysis of coal comprising a pyrolysis tower through which crushed coal and hot gas are counter-currently passed. The tower enables a controlled temperature profile to be maintained in the tower, and contains inner appurtenances which define cascading passageways to promote heat exchange and mixing of the coal with the hot gas. The coal volatiles are carried out of the top of the tower by the gas. The pyrolysis tower may be conjoined with a gasifier so as to most directly utilize the char residuals remaining after pyrolysis of the coal while they are still hot to more efficiently produce a hot synthesis gas, to be used to perform thermal pyrolysis in the tower.

8 Claims, 3 Drawing Sheets

APPARATUS FOR THERMAL PYROIVSIS OF CRUSHED COAL

This is a division of application Ser. No. 06/873,925 filed June 6, 1986, now U.S. Pat. No. 4,900,429, issued Feb. 13, 1990.

INTRODUCTION

This is a division of application Ser. No. 06/873,925 filed June 6, 1986. It relates to apparatus for the thermal pyrolysis of crushed coal to give a high yield of condensible coal volatiles, while diminishing the degradation of reactive compounds in such volatiles during pyrolysis. Conventional forms of a pyrolysis apparatus cause undesirable degradation of the coal volatiles. Further, they do not have adequate means to closely control the temperature of the coal particles at the level at which vaporization of coal volatiles occurs, which is about 850° F. Failure of some or all of the coal particles to reach this level means reduced recovery of coal volatiles, while heating the coal to temperatures exceeding about 850° F. causes thermal degradation of the volatiles and increases the output of non-condensible gases. This has the effect of reducing the proportion of useful condensible volatile product which may be extracted from the coal.

Where the condensible fractions are to be recovered and used as part of the feed for synthetic oil production using a process such as that described in Applicant's U.S. Application Ser. No. 06/873,925, for example, it is especially important to both maximize overall recovery of condensible coal volatiles and to minimize thermal degradation of reactive components during pyrolysis, notably those containing hydrogen double-bonded benzene rings. In the latter process, a blended synthetic crude oil product having benzenoid, paraffinic, napthenic and sulphur components in proportions similar to that found in natural crudes, is produced from a feedstock of non-coal heavy oil, crushed coal and condensed coal volatiles that have been produced by thermal pyrolysis of coal.

The coal volatiles utilized in such a process may, for example, be derived from thermal pyrolysis of crushed coal in an integrated, energy efficient process loop by which the char produced from pyrolysis is gasified to form a synthesis gas, which in turn is used to heat the fresh crushed coal feed for pyrolysis and after being stripped of coal volatiles can be used to produce energy for other uses. Conventional pyrolysis apparatus is not adapted for use in such an integrated, energy efficient process, where the coal char is gasified to produce a synthesis gas, and the sensible heat of which is used for pyrolysis of the incoming crushed coal. A pyrolyzer that can use hot gas to effect pyrolysis at the preferred temperature and which, at the same time, can be efficiently integrated with a gasifier promotes effective use of the sensible heat of the gasifier gas for use in sensitively volatizing the coal volatiles.

SUMMARY OF THE INVENTION

This invention provides apparatus for extracting a high yield of volatiles from coal in the form of non-degraded condensible gases, which can be useful as light oil feed to a synthetic oil production system with which the pyrolysis apparatus can be optimally integrated, or for blending in other processes, or for sale separately for other purposes as light liquid oil. Highly useful coal char residuals are also produced. However, it should be understood that this apparatus is not restricted to use in such a process.

The invention provides for the downward flow of coal particles by gravity in the pyrolyzer in relatively thin streams (as opposed to a dense mass), counter-current to upward flowing hot gas to better promote the extraction of coal volatiles. This is achieved by intimately contacting the hot gas with the dispersed coal particles and controlling the temperature to avoid thermal degradation of the coal volatiles and thereby achieve a favourable ratio of condensible upgradable volatiles to less valuable non-condensible, refractory compounds. The avoidance of thermal degradation of hydrogen double bonded benzene ring compounds in the coal volatiles is of special importance, for example, where the condensed coal volatiles are used as feed stock component for upgrading to a synthetic crude oil, such as referred to in the process of application Ser. No. 06/873,925.

The invention also provides an apparatus adapted preferentially to utilize the sensible heat of synthesis gas, produced, for example, by gasification of char produced in the instant apparatus, to perform the pyrolysis extraction of coal volatiles.

Other objects, features and advantages will be seen from the detailed descriptions which follow and which are referenced in the following drawings:

DETAILED DESCRIPTION OF THE INVENTION

Figure 1:
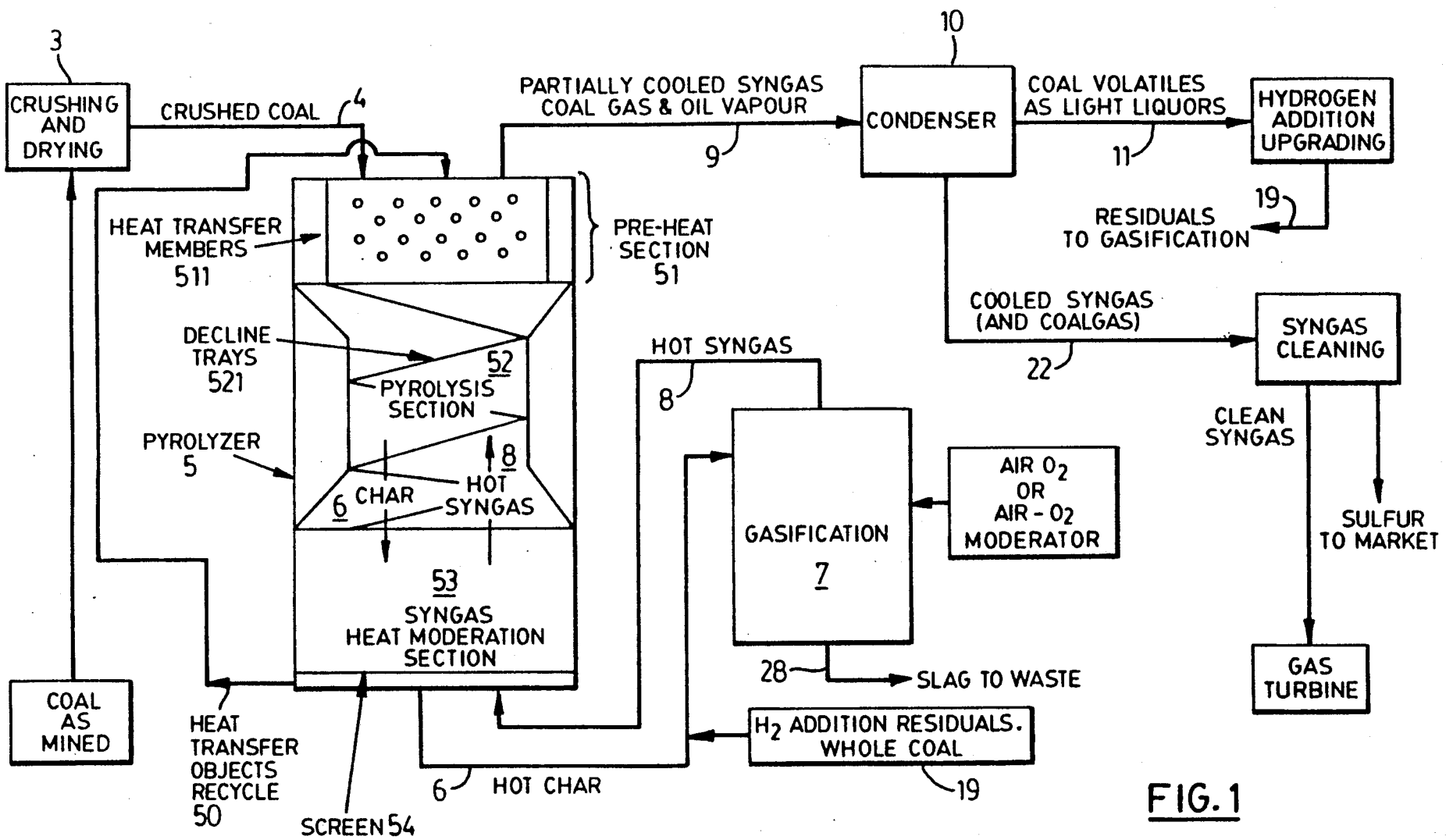
FIG. 1 is a schematic of the pyrolysis apparatus exemplified for use in the production of coal volatiles and residual char when integrated with a gasification step.

One embodiment of the pyrolyzer apparatus as illustrated in FIG. 1 in the context of an integrated pyrolysis and gasification process, consists of two principal sections, a preheat section 51 and a pyrolysis section 52. A heat moderating section 53 may also be desirable. The preheat section consists of a number of horizontal grate-like, crisscrossed members 511 spaced apart throughout a substantial proportion of an upper preheat section 51 of the pyrolyzer tower 5. All of these members will be heated by the upward flowing hot gas, which in the illustrated embodiment is hot synthesis gas produced in a downstream gasifier 7, from hot char 6. Each succeeding lower set of members will be laterally offset from the one above in a manner designed to increase the contact of the falling coal with the hot members and to create, by deflecting the coal and impeding its fall, a semiturbulent flow in which a substantial proportion of the coal particles strike the apparatus and one another and are also more and longer exposed to direct contact with the ascending hot gas. The horizontal grate-like members 511 of the preheat section 51 are preferably spaced sufficiently apart, and of a shape to avoid agglomerations or accumulations of coal particles on them but sufficiently close together to enable heat transfer from the hot gas to permit an increase in temperature from the top to the bottom of the section to the level of 500° F. to 600° F.

Figure 3:
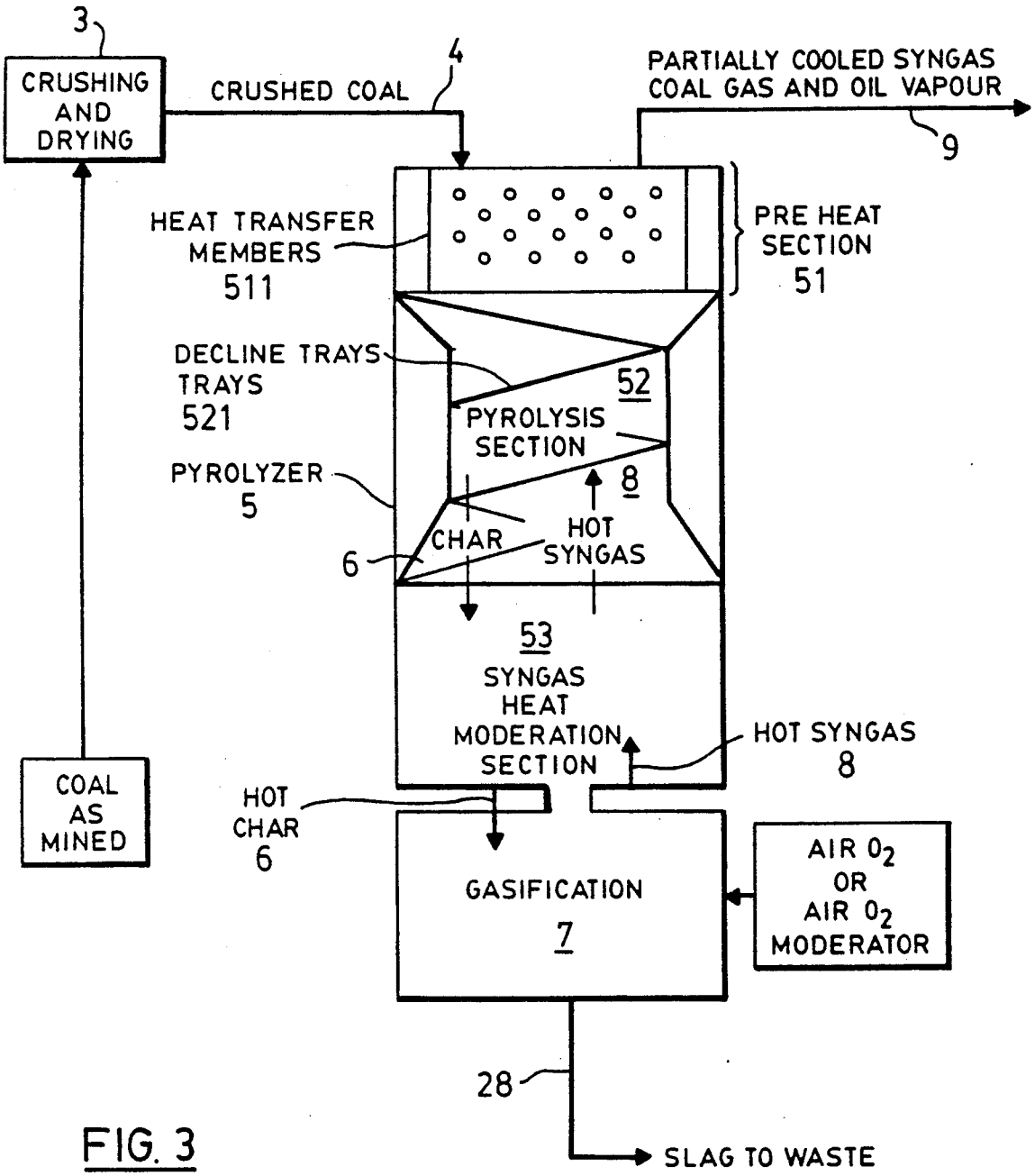
FIG. 3 shows an embodiment of the apparatus in which a pyrolysis tower is conjoined with a gasifier.

In one embodiment, the pyrolysis tower will comprise a vertical tower or vessel stacked directly on, or contiguous to, a partial oxidation gasifier 7 as illustrated in FIG. 3. With the stacked or contiguous arrangement for the pyrolyzer 5 and the gasifier 7, the shortest and most direct transfer of hot gas to the pyrolyzer, and of the char 6 produced in the pyrolyzer to the gasifier, is accomplished.

Heating to the temperature of 850° F. at which coal pyrolysis takes place occurs in the pyrolysis section 52 of the pyrolyzer tower 5 in which chute-like declined trays 521 are arranged in alternating flow directions throughout the section. The tray chute arrangement provides for the descending coal to flow back and forth from one tray chute to the next lower tray chute. The tray chutes 521 are heated to a progressively higher temperatures from top to bottom as the hot gas is gradually cooled as it proceeds up the tower against the bottom of the declined trays and counter-current to the coal flowing downward across the trays, the coal being gradually increased in temperature. The hot gas flowing upward from the bottom of the pyrolyzer 5 will give up a substantial proportion of its sensible heat as it travels up the pyrolyzer creating a declining temperature profile from bottom to top.

The declined chutes or trays 521 which might be appropriately termed tray chutes act principally a heat transfer surfaces. However, they perform other functions. The angle of decline of the tray chutes and the spacing between them are factors in increasing the turbulence of the coal flow thereby increasing heat transfer effectiveness. They also control the time taken for coal to pass through the pyrolyzer. Sufficient surface area of tray chutes is provided to raise the temperature of the descending coal from 500° F. to 600° F. at the top of the section 52 to the pyrolysis temperature of about 850° F. at the bottom of the pyrolysis section 52 It is important to note that the descending coal preferably approaches and then reaches the pyrolysis temperature of about 850° F. at the bottom of the pyrolysis section 52 as it flows by gravity down the last few tray chutes.

In this embodiment, heat transfer from the hot gas to the coal is achieved by four principal means: (1) The direct contact of the counter-current flow of coal with hot gas; (2) The direct contact of the coal with the heated tray chute surfaces and other members of the pyrolyzer apparatus; (3) The exchange of heat between coal particles mixing as they fall with some turbulence across the trays and in particular at points where the coal falls from tray to tray; and (4) Through a general profile of ambient temperature existing in the tower 5 which is highest at the bottom close to the entry of the hot gas and gradually reduced up through the tower. This temperature profile assists in achieving a controlled heat transfer which educes a higher percentage of the coal volatiles while producing residual char. An efficient residence time for each coal particle on the highest temperature tray chutes in the pyrolyzer is estimated at less than 1 minute. However, the residence time may be increased or reduced by increasing or reducing the size of the apparatus and/or modifying the degree of decline in the tray chutes.

As an optional means to increase heat transferred in the pyrolyzer, non-combustible objects of a size substantially greater than that of the coal particles 4 can be added to the crushed coal feed to the pyrolyzer. Multi-sided ball-like shapes comprising metals, ceramics, or other material not subject to heat decomposition or fracturing by collisions with coal particles or the pyrolyzer apparatus, and of a size preferably in the range of 4 to 8 times the diameter of the crushed coal particles, can be added to the crushed coal feed 4. These non-combustible objects would preferably be heated in the pyrolyzer to a temperature in the neighbourhood of 1,200° F. This is preferred as a maximum temperature. These heat transfer objects would be removed out of the coal char 6 by screen 54 leaving the bottom of the pyrolyzer and continuously recycled by recycle means 50 at high temperature to the top of the pyrolyzer 5 to be mixed with new incoming crushed coal 4 and thereby continuously operate as an additional heat transferring vehicle during the time the coal is in the pyrolyzer.

A preferred pyrolyzer 5 will promote a high level of turbulent and collisive activity in the descending coal stream 4. Because of physical interactions of the descending heat transfer objects with the lighter and smaller coal particles, additional turbulence of the descending coal stream would occur through additional deflections and collisions. Beneficial interference with coal agglomerations and scouring of the pyrolyzer apparatus will also result from using such heat transfer objects.

The heat transfer objects could also take the form of large oil shale particles added to the crushed coal feed 4. Such oil shale particles would themselves be stripped of kerogens in the pyrolyzer 5 to provide some additional oil volatiles, with the residual particles being separated and recycled to the pyrolyzer feed as described previously.

The pyrolyzer is preferably insulated to minimize heat loss and constructed of material designed to withstand the high internal temperatures and the friction of hot coal particles and other heat transfer objects passing down through the pyrolyzer.

It will be understood that the pyrolyzer apparatus described above may be modified as required to meet objectives for heat transfer efficiency. The residence time of the coal feedstock may be increased or decreased by increasing or decreasing the overall size of the tower (height or diameter), the number, spacing and area of heat transfer surfaces, the angle of decline of tray chutes, the rate of coal feed and the use of heat transfer objects such as the ceramic shapes or oil shale particles described herein. The degree of turbulence of the descending coal will be affected by such modifications, and heat transfer efficiency will benefit from turbulent mixing. The pyrolyzer may also be operated at a wide range of pressures below 500°to 600°PSI, the approximate pressure at which the gasifier is expected to operate.

As indicated above, the pyrolysis of coal in the unit as described in this particular embodiment allows for the production of a coal volatile component 11, which may be utilized as a feedstock for synthetic oil production, and which has a high benzenoidal content which is highly beneficial as an active agent in improving the conversion of heavy hydrocarbons to light crude oil by hydrogen addition upgrading. At the same time, the production of synthesis gas 8 can be achieved by the use of coal char 6 and optionally upgrading residuals 19 which are essentially waste fuels having had their highest value components stripped out for use in a final product.

This type of operation also yields a coal volatile rich gas stream which is partially cooled and from which heat can be recovered to generate other forms of energy, including waste heat.

FIG. 1 also illustrates cooling of the synthesis gas 8 in a heat moderation section 53 of pyrolyzer 5 with downstream recovery of waste heat from cooled synthesis gas 22 that can be used to produce energy such as steam and electricity for other uses. Other means of cooling the synthesis gas 8 can be used to more directly convert the heat so extracted to forms of energy, such as steam, and thereby reduce the degree to which heat exchangers and waste heat boilers are used.

Figure 2:
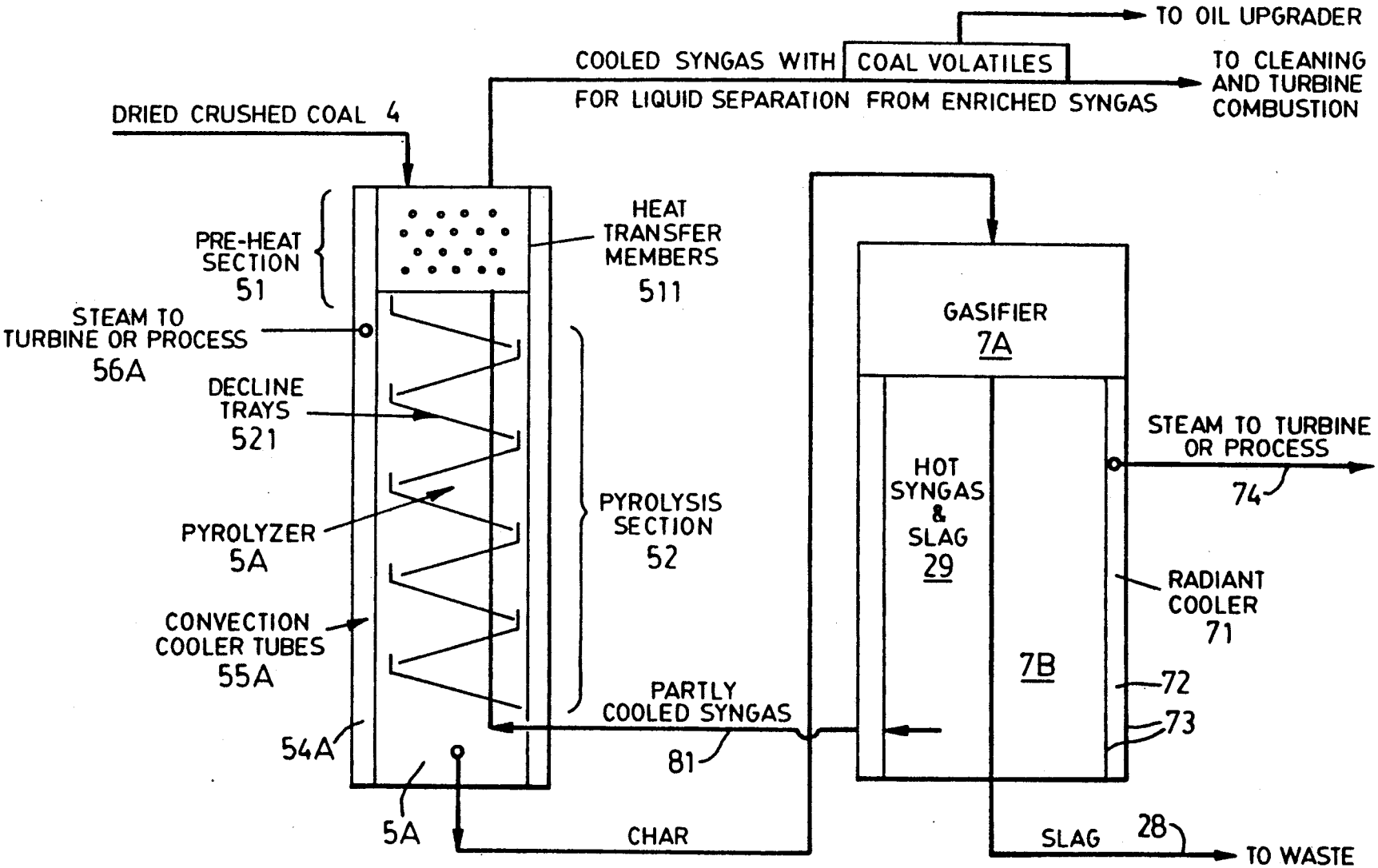
FIG. 2 shows a schematic of a further embodiment of the apparatus with an alternative means for synthesis gas heat moderation and heat recovery for steam production.

FIG. 2 illustrates one such alternative arrangement in which the pyrolyzer is closely integrated with a gasifier which can facilitate better overall system thermal efficiency. The gasifier 7A is equipped in a downstream section 7B with a circumferential radiant cooler 71 through which heat is recovered from the hot synthesis gas 8 and slag 29. For example, the radiant cooler 71 illustrated in FIG. 2 comprises an outer cavity 72 defined by double walls 73. Water can be passed through the cavity 72 to produce steam 74 for other uses. The effect of such radiant cooling is to begin cooling the synthesis gas. Partly cooled synthesis gas 81 can be taken from the downstream cooling section 7B when it reaches a temperature in the area of 1200° F. to 1700° F., preferably around 1200° F., and fed to the bottom of the pyrolysis section 52 of the pyrolyzer 5A. The slag 29 presents a further source of heat energy.

The pyrolyzer 5A as illustrated in FIG. 2 comprises two main sections, the preheat section 51 and pyrolysis section 52 as described with reference to FIG. 1. In addition, it contains a circumferential convection cooling system 54A containing conventional cooling tubes 55A through which water is passed to produce steam 56A that can similarly be used in additional process uses or other energy applications.

To illustrate a process use, the pyrolyzer unit design described above may be used in conjunction with a process as shown in FIG. 1 as follows. Coal is fed to a crushing and drying apparatus 3 and comminuted to a suitable particle size for pyrolysis use and heated until dry at the surface and to an absorbed moisture content of between 5 and 15 percent. This crushed coal 4 may be additionally heated beyond the required drying temperature to attain a temperature of 300° F. to 400° F. prior to pyrolysis in a preheater 3B or in a preheat section 51 of the pyrolysis tower 5, (as illustrated in FIG. 1).

Char 6 produced in the pyrolyzer is gasified in gasifier 7 to yield a synthesis gas 8, which is introduced into the pyrolyzer as a heat supply source and heat carrier for pyrolysis. This synthesis gas also carries the pyrolyzed coal volatiles out of pyrolyzer 5 for condensation 10 and recovery in liquid form 11.

At the point of transfer from the gasifier 7 to the pyrolyzer 5, the hot synthesis gas is preferably in the temperature range of 2,000° F. to 2,400° F., with the temperature at the bottom of pyrolysis section 52 being preferably in the range of 850° F. and decreasing from there upwards. Heat transferred to the descending coal 4 and to the pyrolyzer apparatus in pyrolysis section 52 will create the preferred temperature profile with the temperature of the partially cooled synthesis gas and oil vapour stream 9 at the exit of the pyrolyzer preferably being in the range of 400° F. to 600° F.

It is preferred that the temperature of the pyrolyzer apparatus 5 in its preheat section 51 or of the crushed coal feed 4 entering the preheat section 51, does not drop below that at which condensation of the oil vapours in the synthesis gas will take place in that section 51. Also, heat moderation of the high temperature synthesis gas exiting the gasifier 7 and entering the pyrolyzer 5 to somewhere in the range of 1200° F. to 1700° F. will be carried out in a heat moderation and heat recovery section 53 to maintain the preferred temperature profile in the pyrolyzer 5 and avoid a rise in coal temperature beyond the point at which pyrolysis takes place to a level where products of thermal degradation are produced. Various cooling means may be used in pyrolyzer section 53 to extract heat from the synthesis gas sufficiently to avoid thermal degradation. Partial cooling by heat exchange with heat recovery for process use may be used. Partially cooled and oil vapour stripped synthesis gas 22 may also be recycled to the bottom section of the pyrolyzer 5. Heat moderation of the synthesis gas 8 in the bottom section 53 of the pyrolyzer will also help prevent the coal char residue 6 of pyrolysis from agglomerating and reaching a tacky state where it ma adhere to the inner appurtenances such as tray chutes and heat exchangers or walls of the pyrolyzer 5.

The gasification of hot coal char residuals 6 is carried out in an air, or oxygen enriched air, or oxygen moderated gasifier 7. Gasifier slag 29 will proceed to waste. Alternatively or additionally to oil residuals 19, whole coal varieties 19 may be used to supplement the char residual feed to gasifiers 7.

It should be understood that the use of the invention is not restricted to the process described herein, or variations of it, and that such process is presented for the purposes of illustration only.

I claim:

1. An apparatus for producing coal volatiles and hydrocarbon residuals comprising a pyrolysis tower containing:

(1) an upper section containing a plurality of vertically spaced, grate-like members, each of said members offset laterally from the member above;

(2) a mid-section containing a plurality of declined tray chutes arranged to define cascading passageways through which crushed coal is passed by gravity downwardly counter-current to upwardly flowing hot gas to the crushed coal sufficient to effect thermal pyrolysis of the crushed coal to produce the coal volatiles and hydrocarbon residuals at temperatures which avoid thermal degradation of the coal volatiles; and (3) a bottom section which receives the hot gas and includes means for cooling the gas to prevent degradation of the coal volatiles or heat damage to the pyrolysis tower.

2. An apparatus as claimed in claim 1, further comprising a partial oxidation gasifier conjoined with the bottom end of the pyrolysis tower, wherein the hot gas is synthesis gas produced in the gasifier from gasification of the hydrocarbon residuals remaining after the pyrolysis of the coal.

3. An apparatus as claimed in claims 1 or 2 wherein the cooling means in said bottom section comprises a heat exchanger.

4. An apparatus as claimed in claims 1 or 2 wherein said mid-section of the pyrolysis tower is narrower than the upper and bottom sections so as to promote a more dense packing of the descending crushed coal and rapid rate of pyrolysis in the lower tray chutes disposed in the mid-section, said tray chutes having a surface area which enables the crushed coal particles to slide and fall to succeeding trays in broad, thin streams.

5. An apparatus as claimed in claims 1 or 2 in which the upper section is wider than the mid-section, the width of the upper section promoting free passage of volatile laden hot gas and thereby discouraging condensation of the volatiles in that section.

6. An apparatus as claimed in claims 1 or 2 wherein:

(i) the grate-like members in the upper section comprise criss-crossed grates which subject the descending crushed coal to momentary interruptions and deflections creating a semiturbulent fall pattern, said coal particles being preheated by contact with the rising hot gas, and by contact with the screen members disposed in the section;

(ii) the tray chutes of said mid-section oriented with angles of decline to form said coal particles into broad thin streams that cascade through the section from side to side in alternating directions following said trays, said coal particles being heated by contact with the trays, each other and the rising hot gas, reaching a pyrolysis temperature in the range of 850° F. in the bottom trays of said mid-section.

7. An apparatus as claimed in claims 1 or 2 further comprising means for adding to the crushed coal feed for additional heat transfer effectiveness, (1) a plurality of multi-sided ceramic shapes that are heated as they descend through the pyrolysis tower with the crushed coal feed;

(2) means in the said bottom section of said pyrolysis tower to recover said heated ceramic shapes; and, (3) means to recycle said heated ceramic shapes for re-entry to the upper section of said pyrolysis tower, wherein:

(i) the upper section subjects the descending crushed coal and ceramic shapes to momentary interruptions and deflections creating a semiturbulent fall pattern, said coal particles being preheated by contact with the rising hot gas, by contact with other coal particles and the ceramic shapes and by contact with the screen members disposed in the section;

(ii) the tray chutes of said mid-section forming said coal particles and ceramic shapes into broad thin streams that cascade through the section from side to side in alternating directions following said trays, said coal particles being heated by contact with the trays, each other, the ceramic shapes and the rising hot gas, reaching a pyrolysis temperature in the range of 850° F. in the bottom trays of the mid-section, said ceramic shapes, in addition to providing heat transfer, contributing to turbulence in, and scouring of the inner surface of, said pyrolysis tower.

8. An apparatus for producing coal volatiles and synthesis gas in an integrated coal pyrolysis and hydrocarbon residual gasification system comprising:

(i) a pyrolysis tower, having an upstanding outer enclosing wall, a baffled vertical passageway and a plurality of cooling tubes located adjacent the outer wall, and (ii) a partial oxidation gasifier in communication with the bottom end of said tower, having an adjoining downstream section which in turn has a circumferentially located radiant cooling means, wherein said gasifier downstream section is water cooled and partially cooled synthesis gas is taken from said downstream section and fed to said pyrolysis tower and crushed coal is fed to the top of the said pyrolysis tower, descends the baffled vertical passageway and is pyrolyzed by counter-current contact with said partially cooled synthesis gas, with said partially cooled synthesis gas acting as a carrier of the coal volatiles, the cooling tubes providing means to adjust a temperature profile within the pyrolysis tower.

* * * * *